US008550507B2

(12) United States Patent
Barton et al.

(10) Patent No.: US 8,550,507 B2
(45) Date of Patent: Oct. 8, 2013

(54) WINDOW TILT LATCH SYSTEM

(75) Inventors: Michael A. Barton, Orting, WA (US); Gordon H. Liebel, Buckley, WA (US); Eric A. Baczuk, Puyallup, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 682 days.

(21) Appl. No.: 12/703,659

(22) Filed: Feb. 10, 2010

(65) Prior Publication Data

US 2011/0192089 A1 Aug. 11, 2011

(51) Int. Cl.
*E05C 3/02* (2006.01)
*E05B 63/20* (2006.01)

(52) U.S. Cl.
USPC ..... 292/194; 292/44; 292/61; 292/63; 292/202; 292/228; 292/333; 292/DIG. 20; 292/DIG. 37; 292/DIG. 47; 49/183; 49/185

(58) Field of Classification Search
USPC ..... 292/2–7, 44, 45, 47, 49, 53, 54, 57, 292/58, 60, 61, 194, DIG. 20, DIG. 37, DIG. 47, 292/63–65, 67, 195, 202, 207, 210, 215, 292/219, 332, 333, 335, 336, 197, 221, 222, 292/224, 227, 228, DIG. 70; 49/449, 181–186, 49/445–447; 70/89, 90
See application file for complete search history.

(56) References Cited

U.S. PATENT DOCUMENTS

| | | | | | |
|---|---|---|---|---|---|
| 398,039 | A | * | 2/1889 | Flatman et al. | 292/223 |
| 660,438 | A | * | 10/1900 | Holly | 49/185 |
| 1,434,371 | A | * | 11/1922 | Crompton et al. | 292/333 |
| 2,274,711 | A | * | 3/1942 | Krause | 292/99 |
| 2,545,645 | A | * | 3/1951 | Blakely | 292/127 |
| 2,778,326 | A | * | 1/1957 | Guzik | 109/63.5 |
| 4,351,288 | A | * | 9/1982 | Gasloli | 126/197 |
| 4,624,073 | A | | 11/1986 | Randall | |
| 5,301,989 | A | | 4/1994 | Dallmann et al. | |
| 5,437,173 | A | * | 8/1995 | Spinar | 70/89 |

(Continued)

FOREIGN PATENT DOCUMENTS

| | | | |
|---|---|---|---|
| GB | 2333555 | A | 7/1999 |
| WO | 2006116675 | A2 | 11/2006 |

OTHER PUBLICATIONS

European Extended Search Report and Written Opinion of the European Patent Office for European Application No. 11154029.0, mailed Sep. 25, 2012, 7 pages.

*Primary Examiner* — Carlos Lugo
*Assistant Examiner* — Alyson M Merlino
(74) *Attorney, Agent, or Firm* — Rathe Lindenbaum LLP

(57) ABSTRACT

A tilt latch system that comprises an actuator movable from a first position to a second position; a lock-out member movable from a retracted position to an extended position upon movement of the actuator from the first position to the second position; and an engagement member movable from an engaged position to a disengaged position upon movement of the actuator from the first position to the second position is provided. The actuator and the engagement member are maintained in the second and disengaged positions, respectively, when the lock-out member is in the extended position. The actuator and the engagement member are automatically biased to the first position and the engaged position, respectively, upon movement of the lock-out member from the extended to the retracted position. The tilt latch system may further comprise a lock-out device and/or be optionally utilized in a modular configuration.

16 Claims, 10 Drawing Sheets

(56) References Cited

U.S. PATENT DOCUMENTS

| | | | | |
|---|---|---|---|---|
| 5,592,781 | A | 1/1997 | Mauro | |
| 6,141,913 | A * | 11/2000 | Wong et al. | 49/465 |
| 6,588,150 | B1 * | 7/2003 | Wong et al. | 49/183 |
| 6,669,242 | B2 * | 12/2003 | Fountaine et al. | 292/11 |
| 6,672,009 | B1 * | 1/2004 | Wong et al. | 49/183 |
| 6,877,784 | B2 * | 4/2005 | Kelley et al. | 292/241 |
| 6,938,373 | B2 * | 9/2005 | Wong et al. | 49/183 |
| 7,070,215 | B2 * | 7/2006 | Kelley et al. | 292/241 |
| 7,118,142 | B2 * | 10/2006 | Xu | 292/139 |
| 7,165,791 | B2 * | 1/2007 | Rebel et al. | 292/137 |
| 7,322,619 | B2 * | 1/2008 | Nolte et al. | 292/175 |
| 7,407,199 | B2 * | 8/2008 | Richardson | 292/163 |
| 7,412,800 | B2 | 8/2008 | Maier | |
| 7,591,494 | B2 * | 9/2009 | Mitchell | 292/336 |
| 7,731,251 | B2 * | 6/2010 | Ye | 292/163 |
| 7,812,800 | B2 * | 10/2010 | Peng et al. | 345/83 |
| 7,874,598 | B2 * | 1/2011 | Chung | 292/163 |
| 8,182,001 | B2 * | 5/2012 | Tremble et al. | 292/32 |
| 2004/0195843 | A1 * | 10/2004 | Rotondi et al. | 292/121 |
| 2006/0244270 | A1 * | 11/2006 | Rotondi | 292/213 |
| 2008/0129054 | A1 * | 6/2008 | Tremble et al. | 292/33 |
| 2011/0296880 | A1 * | 12/2011 | Sieglaar et al. | 70/100 |

* cited by examiner

WINDOW TILT LATCH SYSTEM

BACKGROUND

The present invention relates generally to the field of latches, and more particularly to latches for use with a tiltable sash of a windows. Generally, tiltable sashes are opened by sliding the sash upward or downward (depending on the position of the sash and the configuration of the window) and pivoting the sash inward toward a window operator. Tiltable sashes are generally closed by sliding the sash upward or downward and pivoting the sash outward away from the window operator. When a tiltable sash is in the closed position, a tilt latch is typically locked, fixing the tiltable sash relative to a window frame. The tilt latch is unlocked to provide for movement of the tiltable sash between a closed position and an open position. If a tilt latch does not remain in an unlocked position when the tiltable sash is open, damage to the window frame can result. For example, a portion of the tilt latch may be slammed into the window frame when the tiltable sash is moved from the open position to the closed position, denting and/or otherwise damaging the window frame.

SUMMARY

One embodiment of the invention relates to a window and a tiltable latch that comprises a window frame including an interior side generally opposite an exterior side, a first vertical jamb generally opposite a second vertical jamb, and an upper transverse jamb generally above a lower transverse jamb; a sash including a glazing and a sash frame, the sash frame having an interior surface and an exterior surface, an upper rail generally opposite a lower rail, and a first stile generally opposite a second stile; wherein the sash is inwardly pivotable about a horizontal axis generally aligned with the lower rail between a closed position, wherein the sash is generally parallel to the window frame, and an open position, wherein the sash is disposed at an angle relative to the window frame; and wherein the upper rail includes an inner surface generally opposite an outer surface, the outer surface facing an interior surface of the window when the sash is in the closed position and being spaced a distance from the interior surface of the window when the sash is in the open position. The window and tiltable latch further comprises a tilt latch system disposed at least partially within the sash frame and movable between a locked position and an unlocked position, the tilt latch system comprising: an actuator disposed proximate to an upper surface of the upper rail and movable in a direction generally parallel to the first stile between a raised position and a lowered position; an engagement mechanism operatively coupled to the actuator, the engagement mechanism configured to move between an extended position, wherein the engagement mechanism is disposed at least partially within the first vertical jamb, and a retracted position, wherein the engagement mechanism is removed from the first vertical jamb; wherein moving the actuator from the raised position to the lowered position operatively retracts the engagement mechanism, the motion of the engagement mechanism including a component generally perpendicular to the motion of the actuator and being generally parallel to the glazing.

Another embodiment of the invention relates to a tilt latch system for use with a tiltable window and movable between a locked and unlocked position, the tilt latch system comprising: a button assembly, comprising: a bezel including an aperture generally defining a first axis; a button disposed at least partially within the aperture of the bezel, the button being movable in a direction generally parallel to the first axis between a raised position and a lowered position; and a pin movable between an extended position and a retracted position in a direction generally perpendicular to the first axis; a first biasing device biasing the pin toward the extended position. The tilt latch system further comprises at least one cartridge assembly configured to be coupled to the button assembly, the button assembly disposed generally above the cartridge assembly, the cartridge assembly comprising: an inner housing operatively coupled to the button and slidable relative to an outer housing in a direction generally parallel to the first axis; a second biasing device disposed within a cavity formed by the inner housing and the outer housing; and an engagement mechanism disposed at least partially within the cavity and being biased out of the cavity by the second biasing device, the engagement mechanism being movable in a direction generally perpendicular to the first axis between an extended position and a retracted position.

Another embodiment of the invention relates to a method for operating a tilt latch system for use with a tiltable window comprising providing a button assembly coupleable to a cartridge assembly, the button assembly including a button movable along a first axis and a pin movable in a direction perpendicular to the motion of the button, and the cartridge assembly including an engagement mechanism and an inner housing, the inner housing being coupled to the button and movable relative to an outer housing; maintaining the pin in a retracted position; pressing the button to move the button from a raised position to a lowered position; operatively releasing the pin and providing for the pin to move from the retracted position to an extended position; and operatively moving the engagement device from an extended position to a retracted position, the motion of the engagement device including a component generally perpendicular to the motion of the button.

Another embodiment of the invention relates to a tilt latch system that comprises an actuator movable from a first position to a second position; a lock-out member movable from a retracted position to an extended position upon movement of the actuator from the first position to the second position; and an engagement member movable from an engaged position to a disengaged position upon movement of the actuator from the first position to the second position;

wherein the actuator and the engagement member are maintained in the second and disengaged positions, respectively, when the lock-out member is in the extended position, the actuator and the engagement member being automatically biased to the first position and the engaged position, respectively, upon movement of the lock-out member from the extended position to the retracted position.

DETAILED DESCRIPTION

Figure 1:
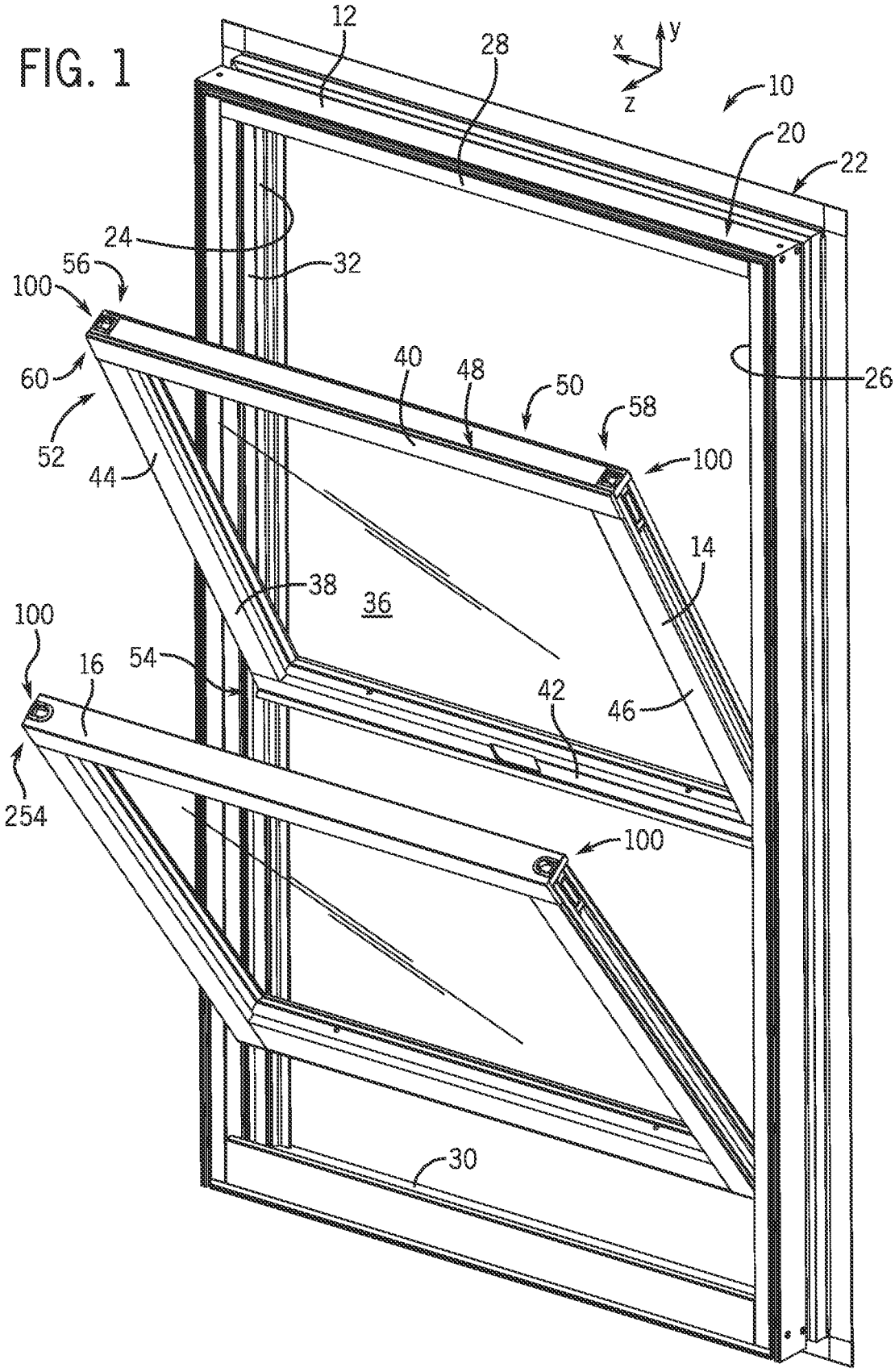
FIG. 1 is a front perspective view of a double hung window including a plurality of tilt latch systems according to an exemplary embodiment.

Referring to FIG. 1, a window 10 is shown as a double-hung window including a window frame 12, a first or upper tiltable sash 14, a second or lower tiltable sash 16 according to an exemplary embodiment. Each tiltable sash is shown utilizing a pair of tilt latch systems 100. Among other benefits, tilt latch system 100 is configured to improve the alignment of the force applied by an operator to unlock the tilt latch systems 100 and the force applied by the operator to move the window 10 from the closed position to the open position. The tilt latch system 100 is also modular and expandable to include multiple points of contact between the tilt latch systems 100 and the window frame 12. It should be noted that each tilt latch system 100 can be considered included in a window (e.g., part of, etc.) or independent thereof (e.g., the tilt latch systems are not part of the components covered by the term "window," tilt latch systems may be used with or added to a window, etc.).

The window 10 is shown disposed vertically and includes an interior or inner side 20 generally opposite an exterior or outer side 22. For purposes of this application, unless otherwise specified, an interior side of a window is generally the side of the window facing an interior of a house, room, or other defined or enclosed space, and the exterior side of a window is generally the side of the window facing an exterior of a house, room, or other defined or enclosed space. Also, the "front" of an element is defined from the perspective of an operator facing the interior side 20 of the window 10. The "rear" of an element is generally defined as opposing the "front" (e.g., extending away from the front) of the window. The forward and rearward directions are generally aligned along the z-axis as shown in FIG. 1. The vertical direction is the direction generally aligned with the force or gravity (e.g., corresponding to the y-direction as shown in FIG. 1). The bottom of an element generally faces or extends toward the ground (i.e., the surface of the earth) and the top of an element generally faces or extends away from the ground and the bottom.

The window frame 12 is shown including a first vertical or side jamb 24 disposed generally opposite a second vertical or side jamb 26 and a first transverse or upper jamb 28 disposed generally above a second transverse or lower jamb 30 (the transverse jambs extending generally in the x-direction as defined in FIG. 1). The window frame 12 provides support for the first sash 14, the second sash 16, and other elements of window 10. The first vertical jamb 24 includes an inner side or surface 32 disposed proximate the first sash 14 and an outer side or surface disposed distal to the first sash 14 relative to the inner surface 32.

Figure 2:
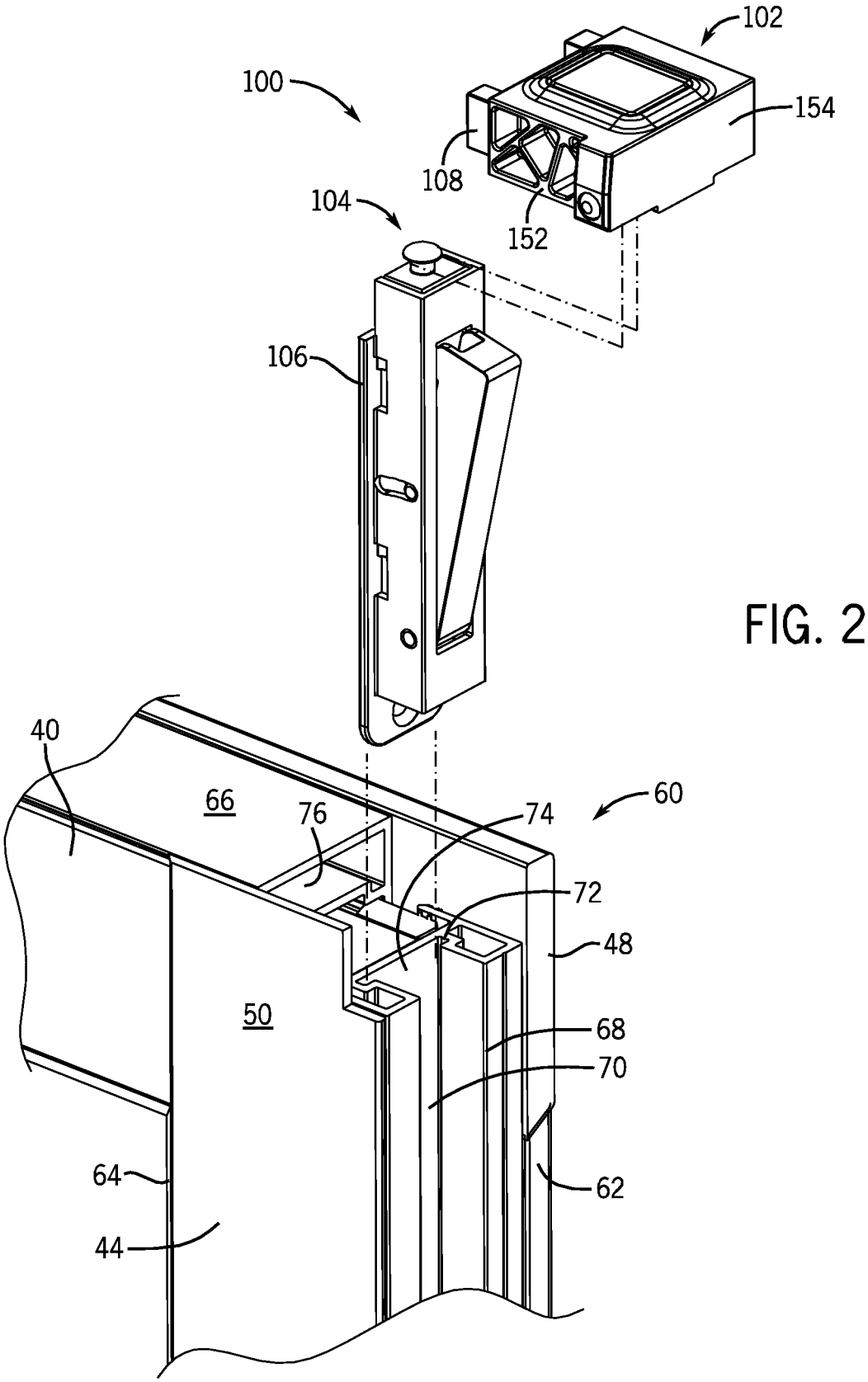
FIG. 2 is partial rear perspective view of the window and a partially exploded tilt latch system according to the exemplary embodiment shown in FIG. 1.

The first sash 14 is shown including a glazing 36 and a sash frame 38. The glazing 36 is confined within and supported by the sash frame 38. The sash frame 38 includes an upper rail 40 generally opposite a lower rail 42 and a first stile 44 generally opposite a second stile 46. The upper rail 40 and the lower rail 42 are oriented generally horizontally (extending along the x-axis) and disposed substantially above and below the glazing 36, respectively. The first stile 44 and the second stile 46 are generally perpendicular to the upper rail 40 and the lower rail 42 and are disposed at the sides of the glazing 36. The sash frame 38 further includes an inner surface 48 generally opposite an outer surface 50 (see FIG. 2 illustrating outer surface 50).

The first sash 14 is slidably and pivotally coupled to window frame 12, providing for the first sash 14 to be pivotally moved between a closed position and an open position. The first sash 14 is shown pivoting about a horizontal axis that is generally aligned with the lower rail 42. To move the first sash 14 from a closed position to an open position, an operator typically slides the first sash 14 downward and pulls the upper rail 40 of the first sash 14 to move it inward and downward. In the open position, the first sash 14 is disposed at an angle to the window 10. To move the first sash 14 from an open position to a closed position, an operator typically slides the first sash 14 downward and pushes the first sash 14 to move it outward. In the closed position, the first sash 14 is disposed generally parallel to the window 10.

According to an exemplary embodiment, the window 10 may be any window including one or more tiltable sashes. For example, the window may include three tiltable sashes, or the window may include one tiltable sash and two fixed sashes. Where the window includes two or more tiltable sashes, all or less than all of the tiltable sashes may utilize the tilt latch systems disclosed herein. For example, a window having two tiltable sashes and one fixed sash may use tilt latch systems to lock and unlock the first tiltable sash and may use tilt latches having a different configuration to lock and unlock the second tiltable sash.

Referring further to FIG. 1, two tilt latch systems 100 are shown disposed at least partially within each sash frame 38 at an upper portion 52 of the first sash 14 disposed generally above a lower portion 54. One tilt latch system 100 is shown disposed at a first side 56 of the first sash 14 and generally aligned with the first stile 44. The other tilt latch system 100 is shown disposed at a second side 58 of the first sash 14 and generally aligned with the second stile 46.

FIG. 2 provides a rear perspective view of a first upper corner 60 of the first sash 14 corresponding to the location where the first stile 44 and the upper rail 40 meet; the tilt latch system 100 is shown exploded from the sash frame 38 at the corner 60. The first stile 44 includes a first side 62 generally opposite a second side 64. The first side 62 of the first stile 44 is disposed adjacent to the inner surface 32 of the first vertical jamb 24 when the first sash 14 is in the closed position. The upper rail 40 includes an upper surface 66.

Referring further to FIG. 2, the tilt latch system 100 includes an actuator assembly shown as a button assembly 102 and a cartridge assembly 104 according to an exemplary embodiment. The cartridge assembly 104 is configured to be removably coupled to the button assembly 102. When the cartridge assembly 104 is coupled to the button assembly 102, the button assembly 102 is disposed generally above the cartridge assembly 104 (e.g., closer to the upper surface 66 of the upper rail 40 than the cartridge assembly 104, etc.).

Referring further to FIG. 2, a track 68 is shown extending generally along and within the first stile 44 according to an exemplary embodiment. The track 68 is configured to slidably receive one or more cartridge assemblies 104. The track 68 defines an aperture 70 that is open to the first side 62 of the first stile 44 and the upper side of the first stile 44. The aperture 70 is shown including a keyed portion 72 and a central portion 74. The keyed portion 72 is configured to correspond to one or more guides 106 of the cartridge assembly 104. The guides 106 are configured to facilitate alignment of the cartridge assembly 104 with the track 68 and facilitate position of the cartridge assembly 104 therein. According to other exemplary embodiments, other alignment features or positioning devices other than guides and/or a track may be used.

Referring further to FIG. 2, the button assembly 102 includes a pair of projections 108 that are received in an opening 76 in the upper rail 40 according to an exemplary embodiment. The projections 108 are configured to help couple the button assembly 102 to the sash frame 38 and prevent movement (e.g., wobbling, etc.) of the button assembly 102 relative thereto.

Figure 3:
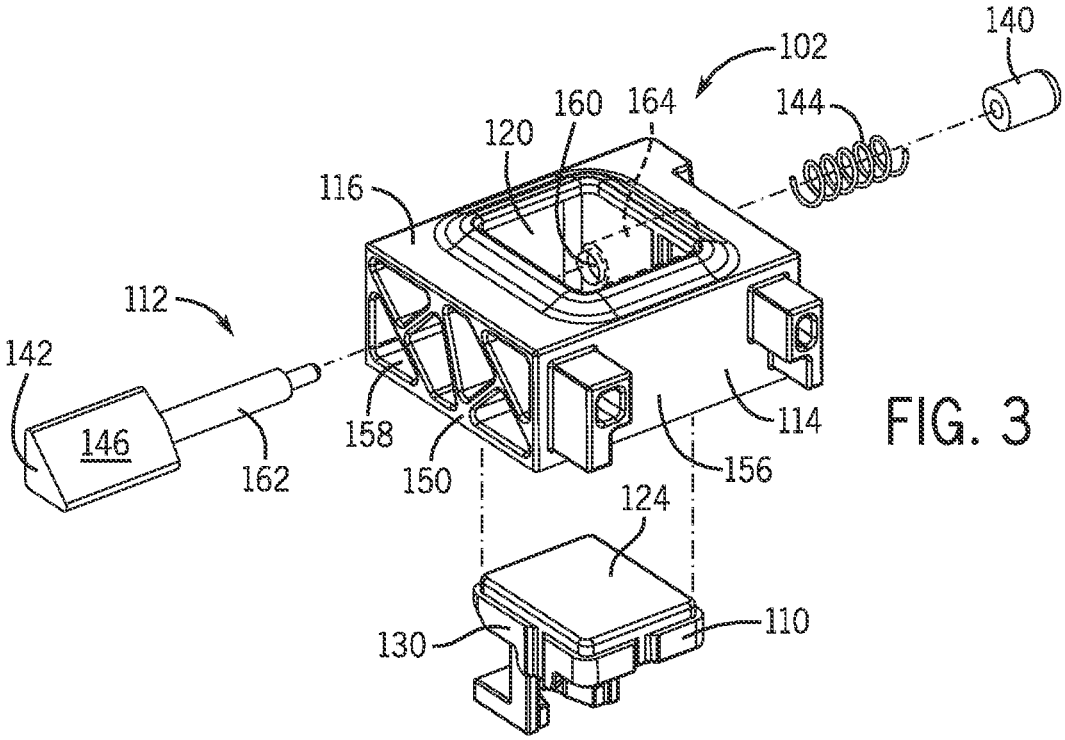
FIG. 3 is an exploded view of the button assembly of the exemplary embodiment of a tilt latch system shown in FIG. 1.
Figure 4:
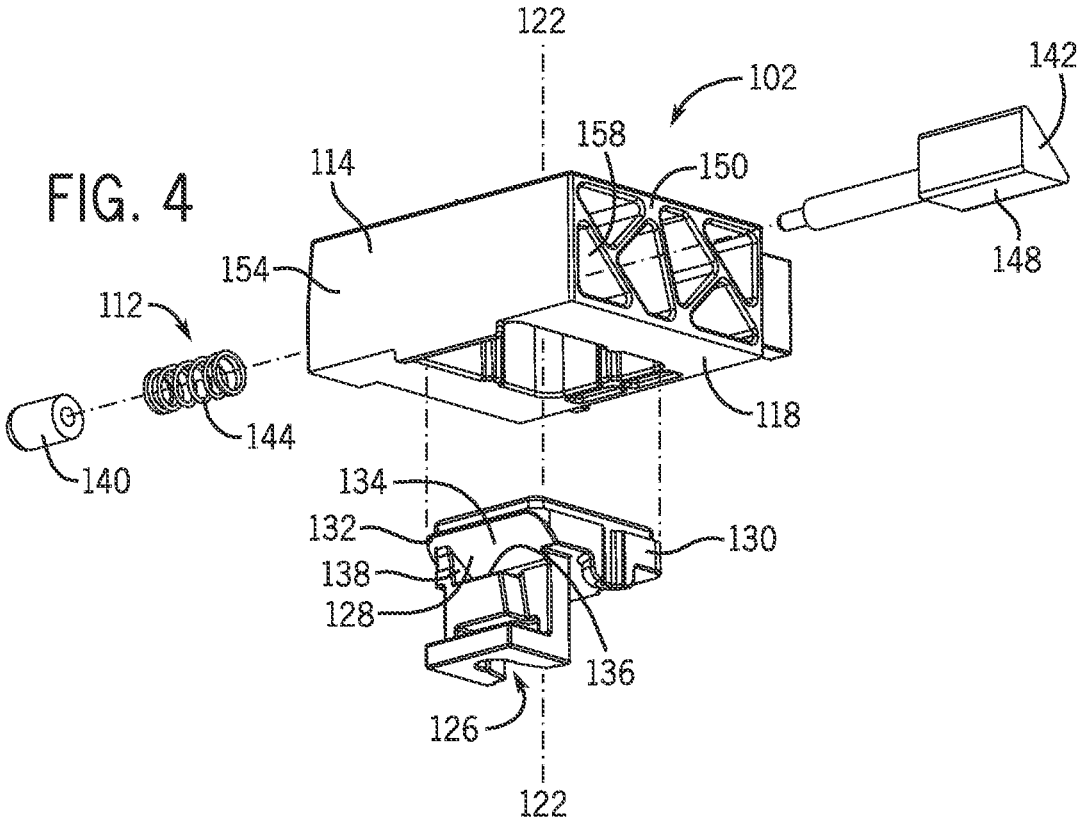
FIG. 4 is another exploded view of the button assembly of the exemplary embodiment of a tilt latch system shown in FIG. 1.

Referring to FIGS. 3-4, the button assembly 102 is shown including an actuator shown as a button 110, an anti-slam or lock-out device 112, and a bezel 114 according to an exemplary embodiment.

The bezel 114 includes a top surface 116, a bottom surface 118, and a first aperture 120 according to an exemplary embodiment. The first aperture 120 is shown extending through the bezel 114, defining a first axis 122. The first axis 122 is generally vertically oriented when the first sash 14 is in the closed position. The first axis 122 is disposed at an angle to the vertical orientation when the first sash 14 is in the open position.

The button 110 (e.g., a pushbutton, a knob, etc.) includes a top surface 124, a first coupling feature 126, and a cavity 128 according to an exemplary embodiment. The button 110 is configured to be slidably movable between a first or raised position and a second or lowered (e.g., depressed, etc.) position. The button 110 is received in the first aperture 120 of the bezel 114. The first aperture 120 helps guide the movement of the bezel 114 by generally defining the path the button 110 travels when moved between the raised position and the lowered position. An operator of the tilt latch system 100 can press the button by touching (e.g., contacting, etc.) the top surface 124 and applying a downward force, causing the button 110 to move from the raised position to the lowered position. According to some exemplary embodiments, the actuator may be any actuator (e.g., a switch, a dial, etc.) configured to be moved generally downward to move the tilt latch system 100 from a locked position to an unlocked position. According to other exemplary embodiments, the actuator may be any actuator configured to facilitate moving the tilt latch system from a locked position to an unlocked position (e.g., a pivotable lever, a rotatable knob, a toggle, a tuner, etc.). It should be noted that the first position and the second position of the actuator may be other than a raised position and a lowered position, respectively (e.g., if the tilt latch system is disposed in a horizontally oriented window, etc.).

The first coupling feature 126 is disposed a distance vertically downward from the top surface 124 of the button. The first coupling feature 126 is configured to be coupled to a second coupling feature of the cartridge assembly 104, which will be discussed in more detail later in this disclosure.

The cavity 128 is shown disposed below the top surface 124 and extending a distance from a front side 130 of the button 110 toward a rear side 132, but not entirely therethrough. The cavity 128 is defined generally by an upper surface 134, a lower surface 136, and a rear surface 138.

The lock-out device 112 is shown including a lock-out member or pin 140, a lock-out stop 142, and a first biasing device shown as a spring 144 according to an exemplary embodiment. The lock-out device 112 is configured to prevent the tilt latch system 100 from undesirably or unintentionally slamming into (e.g., contacting, hitting, crashing against, knocking into, etc.) the window frame 12 or other interior surface of the window 10. Such undesirable or unintentional contact can damage the window frame 12. According to other exemplary embodiments, the biasing element may be any biasing element suitable for providing the desired bias for the lock-out device, which is described in more detail below.

The lock-out stop 142 includes a first beveled surface 146 that faces generally upward and a second surface 148 that faces generally downward according to an exemplary embodiment. The lock-out stop 142 is intended to maintain the button 110 in the lowered position when the tilt latch system 100 is in the unlocked position and the first sash 14 is in the open position. Pressing the button 110 provides for the lock-out stop 142 to be slidably received in the cavity 128 of the button 110. As the button 110 is moved from the raised position to the lowered position, the first beveled surface 146 of the lock-out stop 142 is intended to face and contact (e.g., touch) the upper beveled surface 134 of the cavity 128 of the button 110. Once the tilt latch system 100 is unlocked and the first sash 14 is in the open position, the second surface 148 of the lock-out stop 142 is intended to contact (e.g., touch) the lower surface 136 of the cavity 128 to prevent the button 110 from returning to the raised position until the first sash 14 is closed. By preventing the button 110 from returning to the raised position until the first sash 14 is closed, the lock-out device 112 prevents the button 110 from slamming into the window frame 12 (e.g., first upper jamb 28). While the lock-out stop 142 is shown shaped substantially as a triangular prism, the lock-out stop may be any shape and/or size suitable for maintaining the button in the lowered position.

The bezel 114 is further shown including a front side 150 generally opposite a rear side 152 (see, e.g., FIG. 2 illustrating the rear side 152), a first side 154 generally opposite a second side 156, a second aperture 158, and a third aperture 160 according to an exemplary embodiment. The second aperture 158 is configured to receive the lock-out stop 142 and provide for the lock-out stop 142 to enter the first aperture 120. The second aperture 158 extends from the front side 150 of the bezel 114 through to the first aperture 120. The second aperture 158 is shown extending generally in the x-direction (as defined by FIG. 1) and is shaped to correspond to and/or help guide the movement of the lock-out stop 142 into and out of the first aperture 120. The third aperture 160 is configured to slidably receive an elongated member 162 of the lock-out device 112. The third aperture 160 is shown extending from the first aperture 120 into a pin cavity 164 that extends inward from the rear side 152 of the bezel 114 toward the first aperture 120.

The lock-out stop 142 is received in the second aperture 158 proximate to the front side 150 of the bezel 114 relative to the lock-out pin 140. The lock-out stop 142 is coupled the elongated member 162, which is configured to be coupled to the lock-out pin 140 at an end distal to the lock-out stop 142 and a substantially fixed distance therefrom. The spring 144 is intended to be disposed about the elongated member 162 generally between the lock-out pin 140 and the lock-out stop 142.

The lock-out pin 140 is configured to operatively disengage (e.g., release, etc.) the lock-out device 112 when the first sash 14 is moved from the open position to the closed position.

Both the spring 144 and the lock-out pin 140 are maintained in positions outside of the first aperture 120. The spring 144 is disposed in the pin cavity 164 at the rear side 152 of the bezel 114 and the lock-out pin 140 is disposed rearward of the spring 144. The pin cavity 164 is generally sized and shaped to correspond to the size and shape of the lock-out pin 140, facilitating motion of the lock-out pin 140. It should be noted, however, that the lock-out pin 140 need not be received in a cavity and may simply be movable and disposed proximate to the rear side 152 of the bezel 114. Also, the lock-out pin may be sized and/or shaped in any manner suitable to be extended and refracted in the manner discussed in this disclosure.

The lock-out pin 140 is slidably movable between a first or retracted position (see, FIG. 7) and a second or extended position (see, FIG. 9), the lock-out pin 140 being disposed a greater distance rearward of the outer surface 50 of the sash frame 38 in the extended position than in the retracted position. Positioning the lock-out pin 140 at the rear side 152 of the bezel 114 provides for the lock-out pin 140 to contact the first upper jamb 28 of the window frame 12 when in the extended as the first sash 14 is moved from the open position to the closed position. This contact causes the lock-out pin 140 to move from the extended position to the refracted position. It should be noted that the lock-out pin 140 may be moved inward (forward) by any suitable solid surface of the window (generally an interior surface such as the frame of another sash, a portion of the window frame, etc.).

Figure 5:
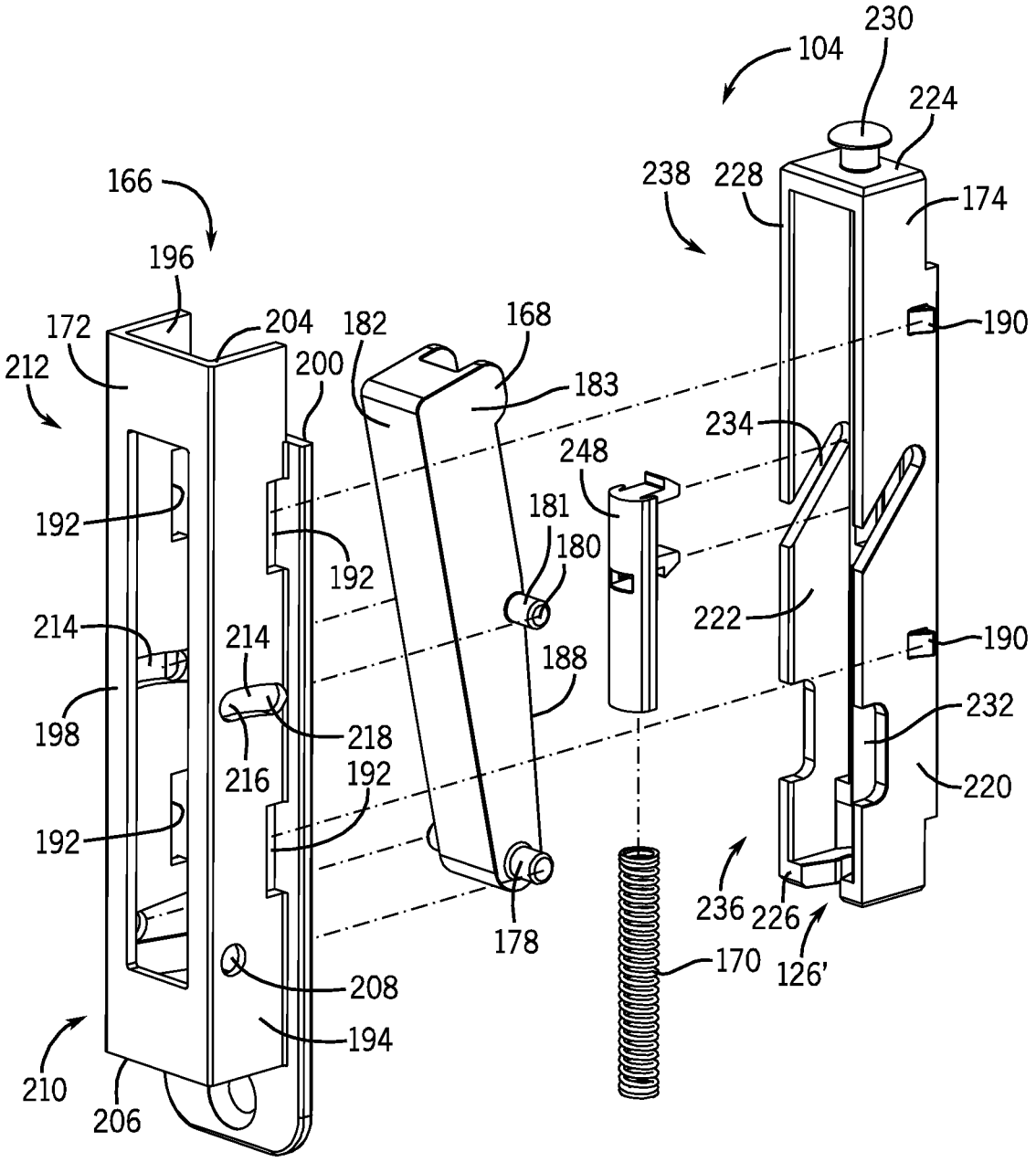
FIG. 5 is an exploded view of the cartridge assembly of the exemplary embodiment of a tilt latch system shown in FIG. 1
Figure 6:
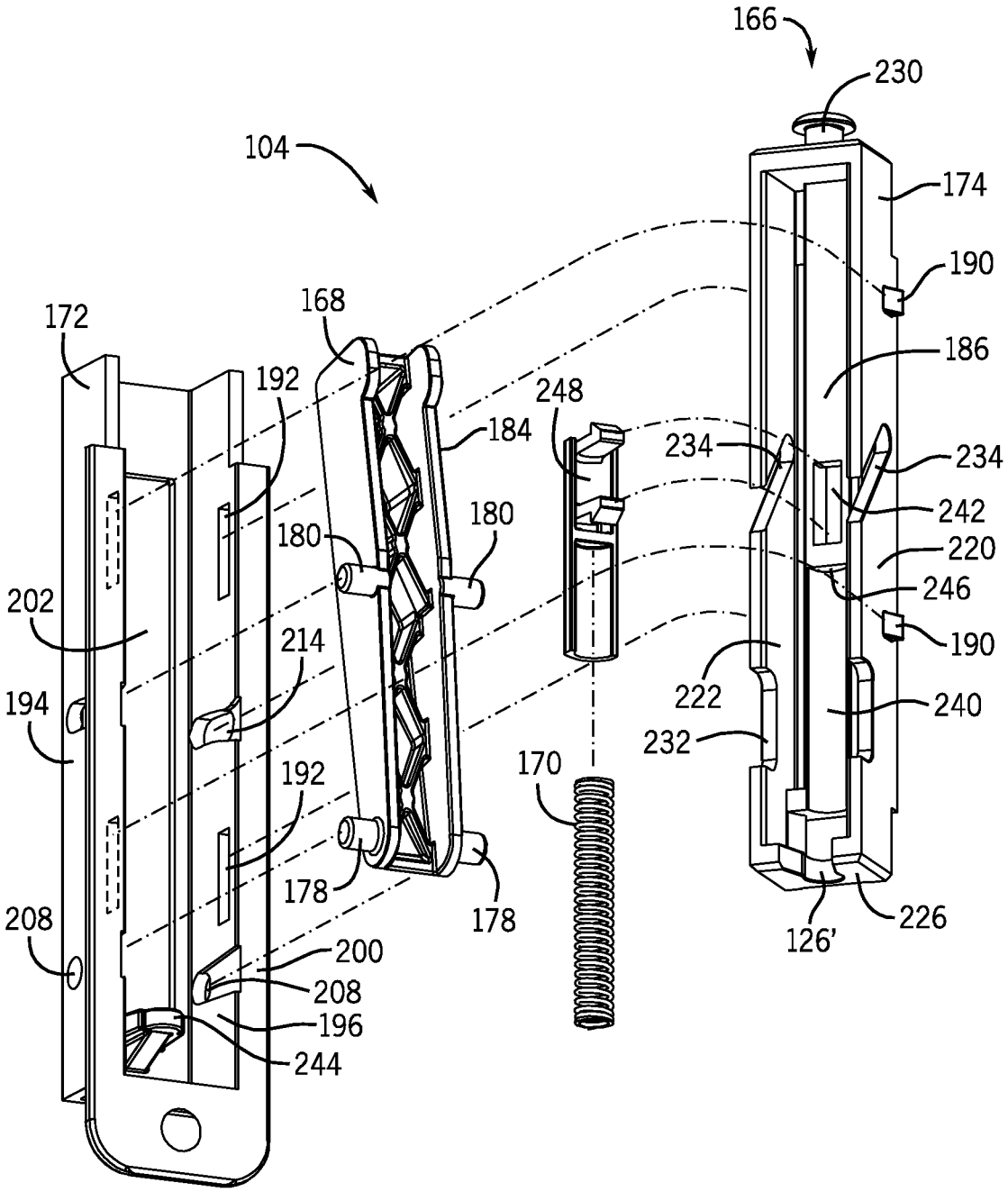
FIG. 6 is another exploded view of the cartridge assembly of the exemplary embodiment of a tilt latch system shown in FIG. 1.

Referring to FIGS. 5-6, the cartridge assembly 104 is shown including a cartridge 166, an engagement mechanism shown as a bolt 168, and a second biasing device shown as a spring 170 according to an exemplary embodiment.

Figure 8:
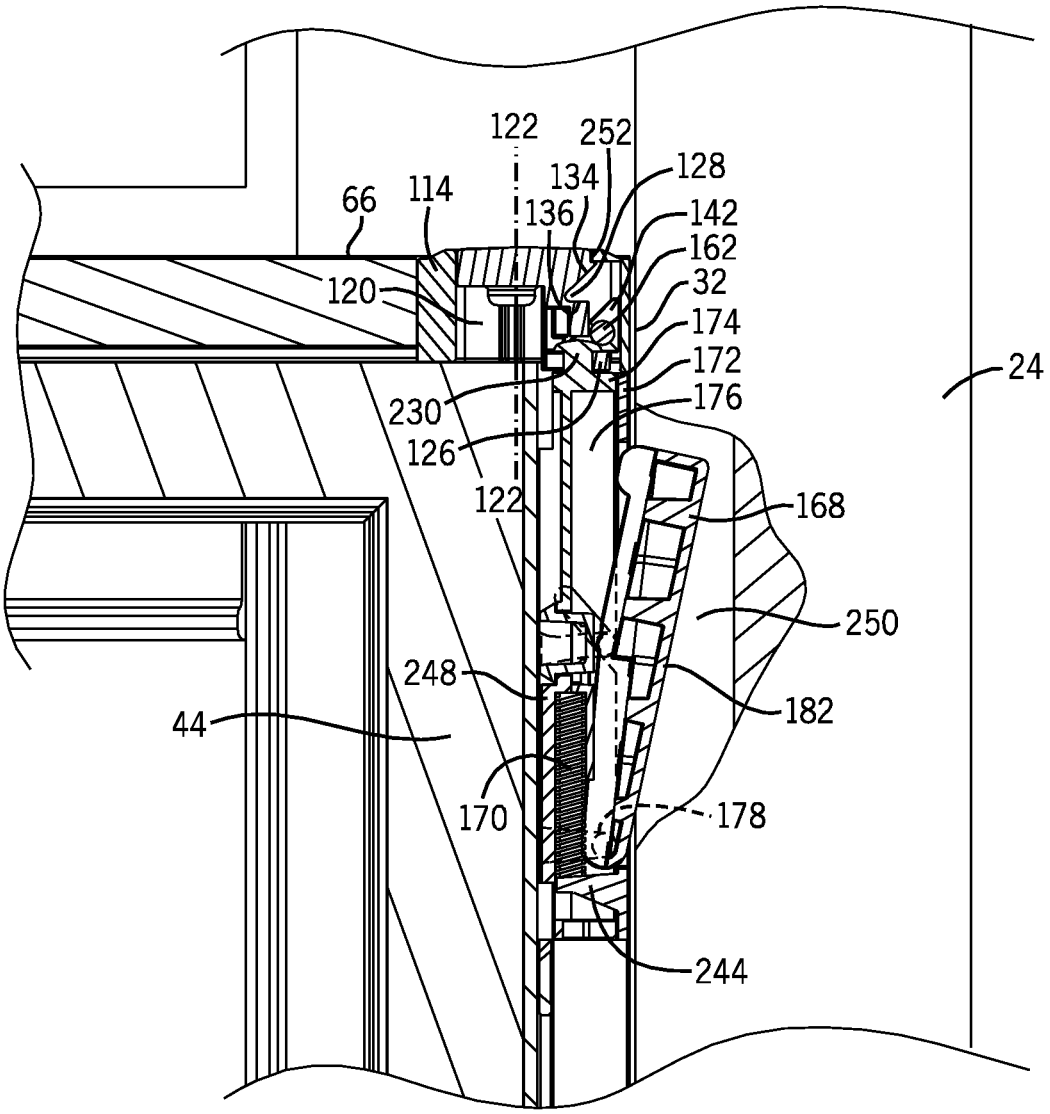
FIG. 8 is a cross-sectional view of the window and the tilt latch system of FIG. 7 taken along line 8-8.

The cartridge 166 is configured to at least partially contain the bolt 168. The cartridge 166 includes an outer housing 172 and an inner housing 174 according to an exemplary embodiment. The inner housing 174 is configured to be at least partially received within the outer housing 172 and thereby define a cavity 176 (see, e.g., FIG. 8 illustrating the cavity 176). The bolt 168 is shown at least partially disposed in the cavity 176 (e.g., enclosure, opening, space, etc.) when the tilt latch system 100 is in the locked position and when the tilt latch system 100 is unlocked. It should be noted that the cartridge 166 is further configured to facilitate and/or guide the movement of the bolt 168, which will be discussed in more detail below.

The bolt 168 is shown including a first set of pivots 178, a second set of pivots 180 having a first surface 181, and a first side 182 generally opposite a second side 184 and a front side 183 generally opposite a rear side 185 according to an exemplary embodiment. The bolt 168 is configured to lock (e.g., secure) the first sash 14 in the closed position by providing a point of contact with the window frame 12. The bolt 168 is configured to be movable between an extended (or engaged) position, wherein the tilt latch system 100 is in the locked position, and a retracted (or disengaged) position, wherein the tilt latch system 100 is in the unlocked position. The first pivots 178 and the second pivots 180 are configured to facilitate and/or guide the movement of the bolt 168. In the extended position, the first side 182 of the bolt 168 is disposed a greater distance from a second wall 186 of the inner housing 174 than in the second side 184. The second side 184 of the bolt 168 includes an angled portion 188 that is shown angled relative to the first axis 122 when the bolt 168 is in the retracted position. According to other exemplary embodiments, the bolt may have any configuration suitable for providing for locking a tiltable sash, preventing the sash from moving from the closed position to the open position.

In the exemplary embodiment shown, the inner housing 174 is configured to be at least partially received within and slidable relative to the outer housing 172. The position of the outer housing 172 is intended to be substantially fixed relative to the first sash 14. The inner housing 174 is configured to be coupled to the button 110. The button 110 and the inner housing 174 are shown configured to operatively move one another between their respective raised and lowered positions. The inner housing 174 includes a plurality of projections 190 configured to be slidably received in a plurality of slots 192 in the outer housing 172. The slots 192 are configured to guide the movement of the inner housing 174 relative to the outer housing 172 and generally define the range of motion of the inner housing 174 along or parallel to the first axis 122. According to other exemplary embodiments, the inner housing and/or the outer housing may include other features to guide the movement of the inner housing relative to the outer housing and/or to generally define the range of motion of the inner housing.

The outer housing 172 is shown including a front wall 194 generally opposite a rear wall 196 and a first wall 198 generally opposite a second side 200. The first wall 198 is disposed proximate to the first vertical jamb 24 of the window frame 12 relative to the second side 200. The first wall 198 includes an aperture 202 (e.g., opening, hole, etc.) configured to allow the bolt 168 to be at least partially movable therethrough. The second side 200 is generally open, facilitating assembly of the cartridge assembly 104. An top side 204 and a bottom side 206 of the outer housing 172 are open.

The outer housing 172 is shown further including a set of holes 208 disposed at a lower portion 210 of the outer housing 172 generally below an upper portion 212. Holes 208 are configured to receive first pivots 178, pivotally coupling the bolt 168 to the outer housing 172. One of the holes 208 is shown extending through the front wall 194 and another hole 208 is shown extending through the rear wall 196.

The outer housing 172 is shown further including a set of slots 214 spaced a distance from the holes 208. Slots 214 are configured to receive second pivots 180, slidably coupling the bolt 168 to the outer housing 172. The first surface 181 of each of the second pivots 180 is in contact with the surface of the outer housing 172 defining the slots 214. The slots 214 are shown extending generally perpendicular to the first axis 122 in the x-direction as indicated in FIG. 1, providing for movement (e.g., articulation, etc.) of bolt 168 towards and away from the first vertical jamb 24. A first portion 216 of each slot 214 is disposed closer to the first vertical jamb 24 than a second portion 218. While the slots 214 are shown disposed above the holes 208, the slots may be disposed below the holes according to other exemplary embodiments. Further, the slots and holes may have any suitable size and/or shape. According to other exemplary embodiments, the slots may be any elements or features facilitating or providing for movement of the bolt towards and away from the jamb.

The inner housing 174 is shown including a front wall 220 generally opposite the rear wall 222, a top wall 224 generally opposite a bottom wall 226, and a first side 228 that is open and generally opposite the second wall 186.

A second coupling feature 230 is disposed on or generally above the top wall 224 of the inner housing 174. The second coupling feature 230 is configured to couple the inner housing 174 to the button 110. The second coupling feature 230 provides a snap-fit (e.g., a mechanical joint system where part-to-part attachment is accomplished with locating and locking features to connect components together) with the first coupling feature 126 of the button 110, providing for the cartridge assembly 104 and the button assembly 102 to be removably coupled. According to other exemplary embodiments, other coupling features and/or coupling features providing other types of fits may be used. For example, the coupling features may be screw-type devices or the snap-fit may be achieved using a cantilevered snap-fit or a spherical snap-fit.

Another first coupling feature 126' is shown disposed on or proximate to the bottom wall 226 of the inner housing 174. This first coupling feature 126' of the cartridge assembly 104 provides for another cartridge assembly to be coupled to the bottom of the cartridge assembly shown in FIGS. 5-6. In this way, the tilt latch system 100 is configured to be modular. The modular use and an exemplary modular configuration of tilt latch system 100 will be discussed in more detail below.

The inner housing 174 further includes a first set of slots 232 and a second set of slots 234 according to an exemplary embodiment. The first slots 232 are included at or proximate a bottom portion 236 of the inner housing 174 disposed generally below an upper portion 238. The first slots 232 are configured to slidably receive the first pivots 178 of the bolt 168 so that the first pivots 178 do not restrict the motion of the inner housing 174 relative to the outer housing 172 along the first axis 122. The first slots 232 extend generally vertically and parallel to one another, one of the first slots 232 shown extending through the front wall 220 and the other shown extending through the rear wall 222. The second slots 234 are also shown positioned having one slot 234 extending through in each of the front wall 220 and the rear wall 222. The second slots 234 are configured to restrict the motion of the bolt 168 as inner housing 174 moves between the raised position to the lowered position. The second slots 234 are shown substantially parallel to one another and extending generally diagonally upward moving in a direction away from the first vertical jamb 24 of the window frame 12 (along the x-axis) and toward the second vertical jamb. As the inner housing 174 is lowered relative to the outer housing 172, the second pivots 180 of the bolt 168 move upward in second slots 234 and away from the first vertical jamb 24. Accordingly, moving the button 110 from the raised position to the lowered position operably retracts the bolt 168.

The inner housing 174 defines a first cavity 240 and a second cavity 242 according to an exemplary embodiment. The first cavity 240 is configured to help position the spring 170 in the inner housing 174. The spring 170 is configured to bias the inner housing 174 upwardly and the bolt 168 toward the extended position. In the exemplary embodiment shown, the spring 170 is disposed at least partially in the first cavity 240 and substantially constrained vertically between a platform 244 and an upper surface 246 of the first cavity 240 in combination with a spring clip 248. The spring 170 is disposed generally parallel to the first axis 122. The platform 244 is disposed below the spring 170 and extends from the first wall 198 of the outer housing 172 toward the second wall 186 of the inner housing 174. The spring clip 248 is disposed at least partially above the spring 170 and is coupled to the inner housing 174 at the second cavity 242 using a cantilevered snap-fit. In response to the movement of the inner housing 174 downward relative to the outer housing 172, the spring 170 is compressed between the platform 244 and the spring clip 248 and the upper surface 246. According to other exemplary embodiments, a device other than the spring clip may be included to help hold the spring in position (e.g., a molded pin, or a molded compression fit cavity wrapped around a portion of the spring, etc.).

Referring to FIGS. 7-10, the operation of the tilt latch system 100 will now be discussed. For the purposes of simplicity, the discussion will focus on the tilt latch system 100 shown in FIG. 2. Though, it should be understood that both tilt latch systems 100 shown coupled to the first sash 14 in FIG. 1 will be operated in order to operate the first sash 14 of the window 10 (e.g., unlocking and opening the window, closing the window, etc.).

In the exemplary embodiment shown, the exterior of the tilt latch system 100 is shown generally flush with the exterior surfaces of the sash frame 38 when assembled and installed therein, providing aesthetic benefits and/or function. For example, the top surface 124 of the button 110 is substantially flush with the upper surface 66 of the upper rail 40, providing for the tilt latch systems 100 to be substantially hidden when the first sash 14 is in the closed position. Also, this configuration prevents the button 110 from interfering with closing the sash (e.g., by contacting a portion of the window frame 12). It should be noted, however, the assembly and/or installation of the tilt latch system and the window may be varied in accordance with this disclosure (e.g., the bezel may extend a distance above or below the upper surface 66 of the upper rail 40, the button may have an alternative decorative shape or style as discussed in more detail below in reference to FIG. 11, etc.).

Figure 7:
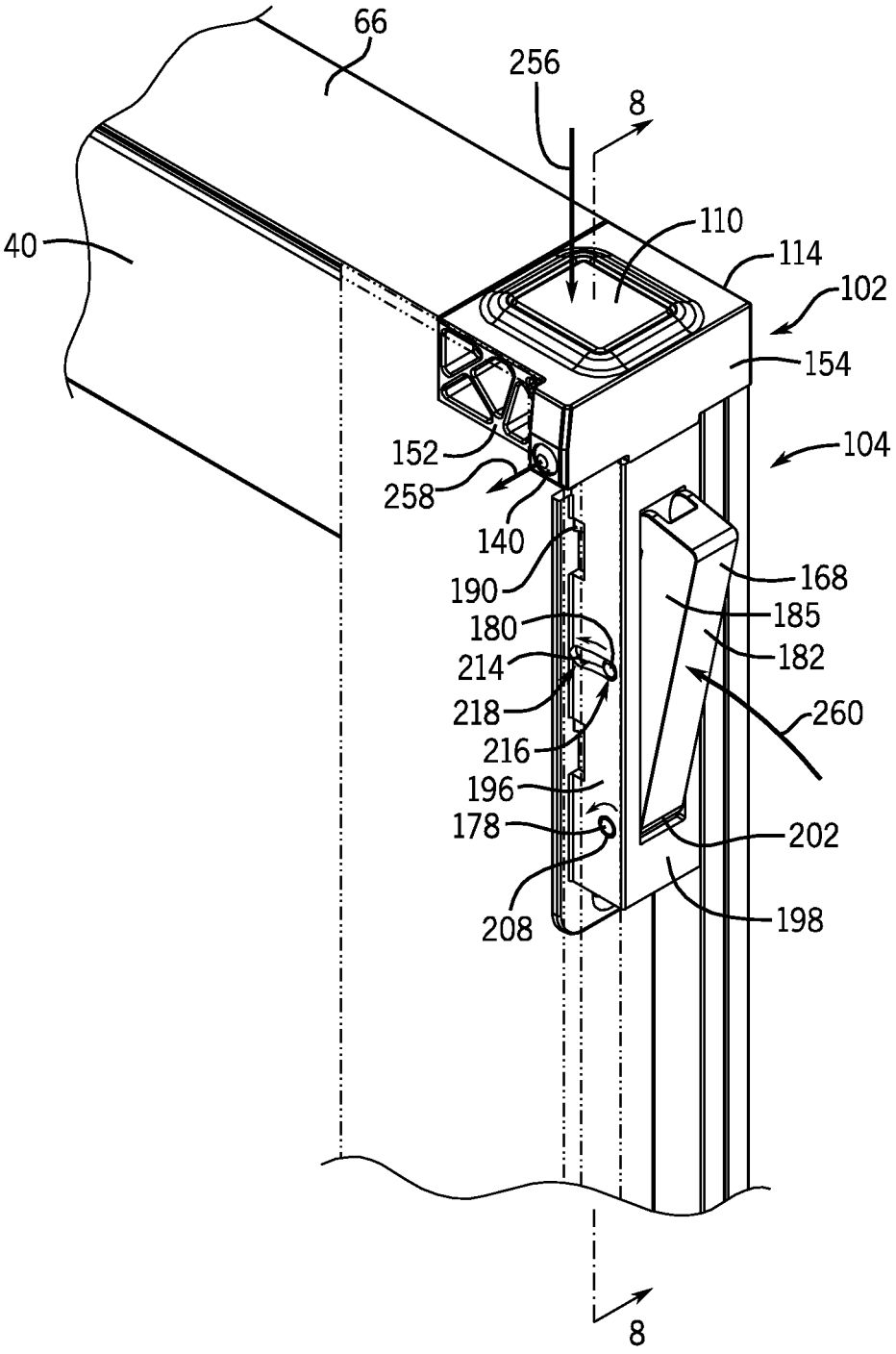
FIG. 7 is a partial rear perspective view of the window in the closed position and the tilt latch system in the locked position according to the exemplary embodiment shown in FIG. 1.

Referring to FIGS. 7-8, the first sash 14 is shown in the closed position and the tilt latch system 100 is shown in the locked position. When the tilt latch system 100 is in the locked position, the button 110 is in the raised position, the bolt 168 is in the extended position, and the lock-out pin 140 is in the retracted position. In the extended position, the bolt 168 is at least partially disposed in a cavity 250 (e.g., opening, aperture, hole, etc.) in the first vertical jamb 24 of the window frame 12. The receipt of the bolt 168 provides a point of contact between the first sash 14 and the window frame 12, helping to maintain the first sash 14 in the closed position. The bolt 168 substantially prevents the first sash 14 being tilted (e.g., pivoted) because the front surface 183 and/or the rear surface 185 of the bolt 168 will contact an inner surface of the first vertical jamb 24 defining the cavity 250. For example, were an operator to attempt to tilt the first sash 14 inward, the front surface 183 of the bolt 168 would contact the inner surface of the first vertical jamb 24 defining the cavity 250, preventing inward motion therebeyond.

Focusing on the button assembly 102, in the raised position the button 110 operably maintains the lock-out pin 140 in the retracted position. The cavity 128 of the button 110 is offset a distance from the lock-out stop 142 of the lock-out device 112. The lock-out stop 142 contacts the front side 130 of the button 110. Because the lock-out pin 140 is fixed relative to the lock-out stop 142, the lock-out pin 140 cannot be moved without corresponding movement of the lock-out stop 142. Preventing the lock-out stop 142 from entering cavity 128 prevents the lock-out pin 140 from moving rearward (e.g., outward) and counteracts the biasing effect of the spring 144. Accordingly, the lock-out pin 140 is maintained in the retracted position while the button 110 is in the raised position.

Focusing on the cartridge assembly 104, the inner housing 174 is shown in the raised position. The spring 170 biases the inner housing 174 and the button 110 to their respective raised positions. A bottom portion of the spring 170 is disposed on the platform 244 of the outer housing 172, which is fixed relative to the first sash 14. The spring 170 creates an upward force on the spring clip 248 and the upper surface 246 of the first cavity 240. The button 110, which is coupled to the inner housing 174, is biased upwards. The button 110 may be prevented from being biased upward beyond the desired height by a lip 252 that catches (e.g., is stopped by, etc.) the bezel 114 or another suitable feature.

When the inner housing 174 is in the raised position, the spring 170 also biases the bolt 168 to the engaged position. The bolt 168 is pivotally fixed relative to the outer housing 172. When the inner housing 174 is in the raised position, the spring clip 248 is at a first location relative to the bolt 168. At this first location, the spring clip 248 is proximate to the angled portion 188 of the second side 184 of the bolt 168 at a location where the bolt 168 is relatively wide (side-to-side along the x-axis). The second pivots 180 are maintained substantially in the first portions 216 of the slots 214 proximate the first wall 198 of the outer housing 172, maintaining the bolt 168 in the engaged position, as shown in FIG. 7.

Referring to FIGS. 7-8, to unlock the window 10, an operator slides the first sash 14 downward to access the button 110 of button assembly 102. It should be noted that for second sash 16, the second sash 16 would first be slidably moved upward, to avoid interference with the lower jamb 30 when the second sash 16 is tilted inward. It should also be noted that a separate locking device or system is utilized to permit and restrict the sliding movement of the sashes (e.g., downward for the first sash and upward for the second sash).

According to an exemplary embodiment, the first and/or second sash are slidable relative to the window frame with the bolts of the tilt latch systems installed therein in the engaged position. The distance through which these sashes are slidable may be adjusted by adjusting the distance the cavities (e.g., the cavity 250) that receive the bolts extend vertically within the vertical jambs. For example, the distance the second sash 16 is slidable could be restricted to the distance required for the second sash 16 to clear the lower jamb 30. In another example, the second sash 16 could be upwardly slidable a distance greater than the distance required for the second sash 16 to clear the lower jamb 30. In an alternative exemplary embodiment, one or more of the sashes may be prevented from slidably moving relative to the window frame when the bolts are in the engaged position (e.g., by sizing the cavities in a vertical sashes to substantially correspond to the height of the bolt (as defined along the y-axis), etc.).

Referring to FIG. 7, the operator then presses button 110, moving the button 110 from the raised position to the lowered position according to an exemplary embodiment. As the tilt latch system 100 is moved from the locked position to the unlocked position, the button 110 moves vertically downward as indicated by motion arrow 256, the lock-out pin 140 is no longer maintained in the retracted position and is movable in a rearward direction perpendicular to the movement of the button 110 (and perpendicular to the glazing 36) as shown by motion arrow 258. Also, the bolt 168 pivots substantially horizontally (in the x-direction) towards the cavity 176 of the cartridge 166 as shown by motion arrow 260. At least one component of the motion of the bolt 168 is perpendicular to the motion of the button 110. The motion of the bolt 168 is also generally parallel to the glazing 36.

As the button 110 moves vertically downward, the inner housing 174 of the cartridge assembly 104 also moves vertically downward, moving from its raised position to its lowered position. As the inner housing 174 moves downward, the spring 170 is increasingly compressed between the platform 244 and the spring clip 248 and the first cavity 240. The spring clip 248, which is coupled to the inner housing 174, is moved to a second location relative to the bolt 168, lower than the first position. At this second location, the spring clip 248 is disposed proximate to a location of the bolt 168 that is relatively thin (e.g., side-to-side, in the x-direction, etc.), the change in widths being the result of the angled portion 188 of the second side 184, helping to provide space for retraction of the bolt 168 into the cartridge 166. At the same time the spring clip 248 is being moved downward, the second slots 234 of the inner housing 174 move downward relative to the second pivots 180 of the bolt 168. The angle of the second slots 234 upward and away from the first vertical jamb 24 forces the second pivots 180 toward the second wall 186 and into the second portions 218 of the slots 214 of the outer housing 172 as the inner housing 174 moves downward. As the second pivots 180 are moved from the first portions 216 of the slots 214 toward the second portions 218, the bolt 168 pivots about first pivots 178 (as shown in FIG. 7) and is retracted towards the second wall 186 of the inner housing 174 and removed from the cavity 250 in the first vertical jamb 24. With the bolt 168 removed from the cavity 250, the first vertical jamb 24 no longer prevents motion of the first sash 14 relative thereto.

Pressing the button 110 also provides for engagement of the lock-out device 112. As the button 110 is lowered, the cavity 128 is brought in line with the lock-out stop 142. The spring 144, which was maintained in a compressed state, now has the ability to expand because the lock-out stop 142 can be moved (e.g., received, etc.) into the cavity 128, being no longer obstructed by the front side 130 of the button 110. Even after pressing the button 110, the lock-out pin 140 is still substantially prevented from moving from the retracted position to the extended position because it is in contact with a solid or interior surface (here, the first upper jamb 28) of the window 10. The lock-out pin 140 moves generally rearward relative to the bezel 114 from the retracted position to the extended position as the first sash 14 is tilted inward toward the operator, moving the lock-out pin 140 away from the first upper jamb 28. The lock-out stop 142, which is fixed relative to the lock-out pin 140, also moves rearward and into cavity 128.

The button 110 is maintained in the lowered position by the lock-out stop 142 after the lock-out pin 140 is no longer in the retracted position. As the lock-out stop 142 moves into the cavity 128, the upper beveled surface 134 of the cavity 128 contacts the first beveled surface 146 of the lock-out stop 142. The contact between the upper beveled surface 134 of the cavity 128 and the first beveled surface 146 of the lock-out stop 142 prevents the button 110 from being moved downward beyond a desired location. When the operator is no longer pressing the button 110 downward, the second surface 148 of the lock-out stop 142 contacts the lower surface 136 of the cavity 128 of the button 110, preventing the spring 170 from operatively biasing the button 110 to the raised position and, thereby, maintaining the button 110 in the lowered position. It should be noted that the rear surface 138 of the cavity 128 acts as a stop, constraining the rearward motion of the lock-out stop 142, and, accordingly, the rearward motion of the lock-out pin 140 to maintain them in the desired positions. It should also be noted that, by preventing the button 110 from returning to the raised position (i.e., maintaining the button 110 in the lowered position) until the first sash 14 is closed, the lock-out stop 142 of the lock-out device 112 prevents the bolt 168 from slamming into the window frame 12 (e.g., first vertical jamb 24).

In the exemplary embodiment shown, tilting the first sash 14 inward typically involves applying a force that has a downward component of motion and an inward component of motion (e.g., along the z-axis as shown in FIG. 1). Also, as noted above, the button 110 is pressed in a downward direction to unlock the first sash 14 so that the first sash 14 may be moved from the closed position to the open position. Accordingly, at least one component of motion involved in each of unlocking the tilt latch system 100 and moving the first sash 14 from the closed position to the downward position is aligned. Further, the aligned motion components are generally perpendicular to at least one component of motion of the engagement mechanism (here, the bolt 168). Aligning the components of motion facilitates unlocking and opening the tiltable sashes. Aligning the components of motion further makes performing the actions of unlocking the tilt latch system and opening the window substantially more ergonomic.

In the exemplary embodiment shown, the bezel 114 is configured to act as a finger hold (e.g., pull assist) for the operator, facilitating applying a force to move the first sash 14 from the closed position to the open position. For example, with the button in the lowered position, an operator can position one of their fingers a distance into the first aperture 120 of the bezel 114 and pull (e.g., facilitation applying the downward force).

Figure 9:
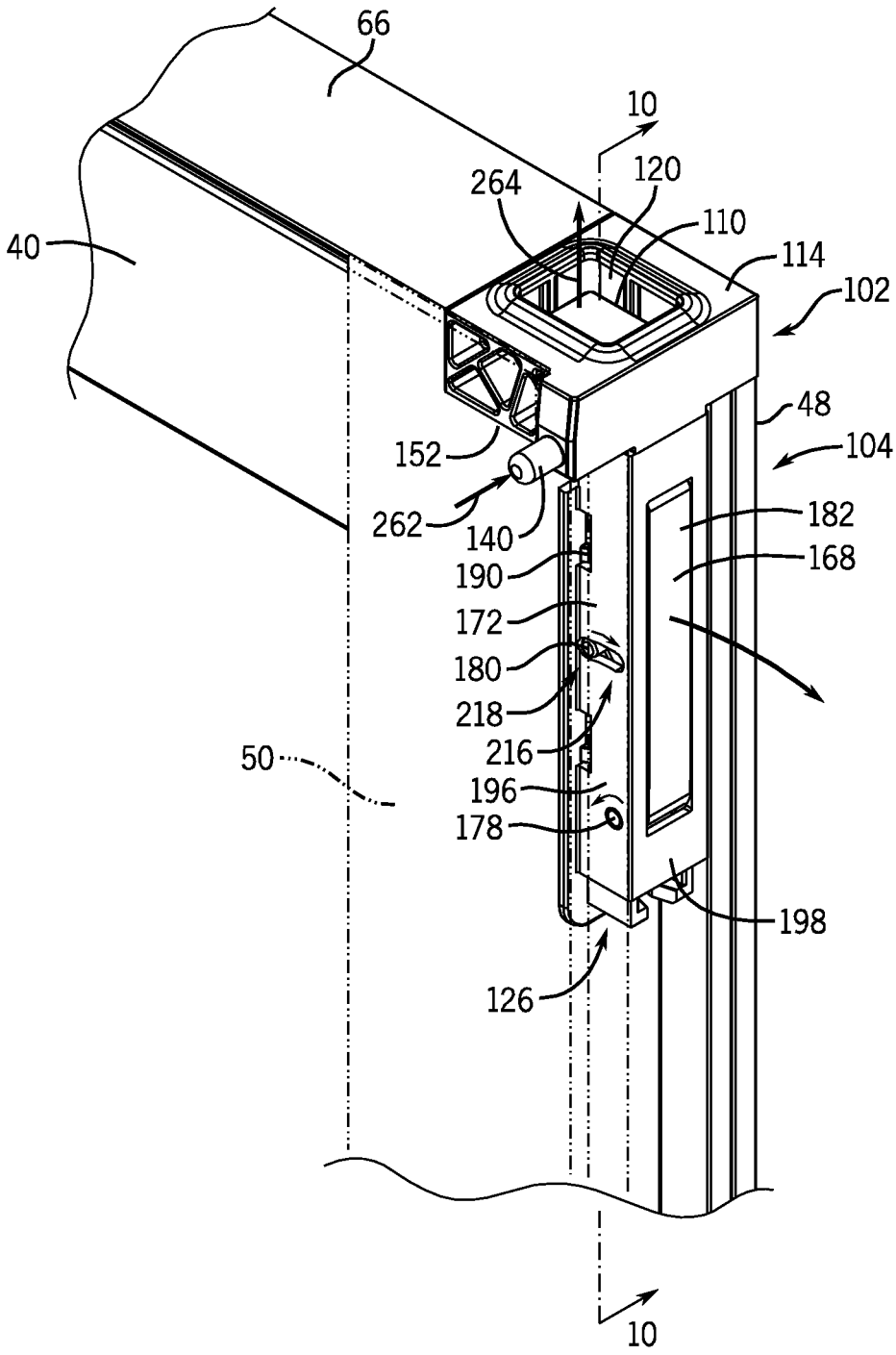
FIG. 9 is a partial rear perspective view of the window in the open position and the tilt latch system in the unlocked position according to the exemplary embodiment shown in FIG. 1.
Figure 10:
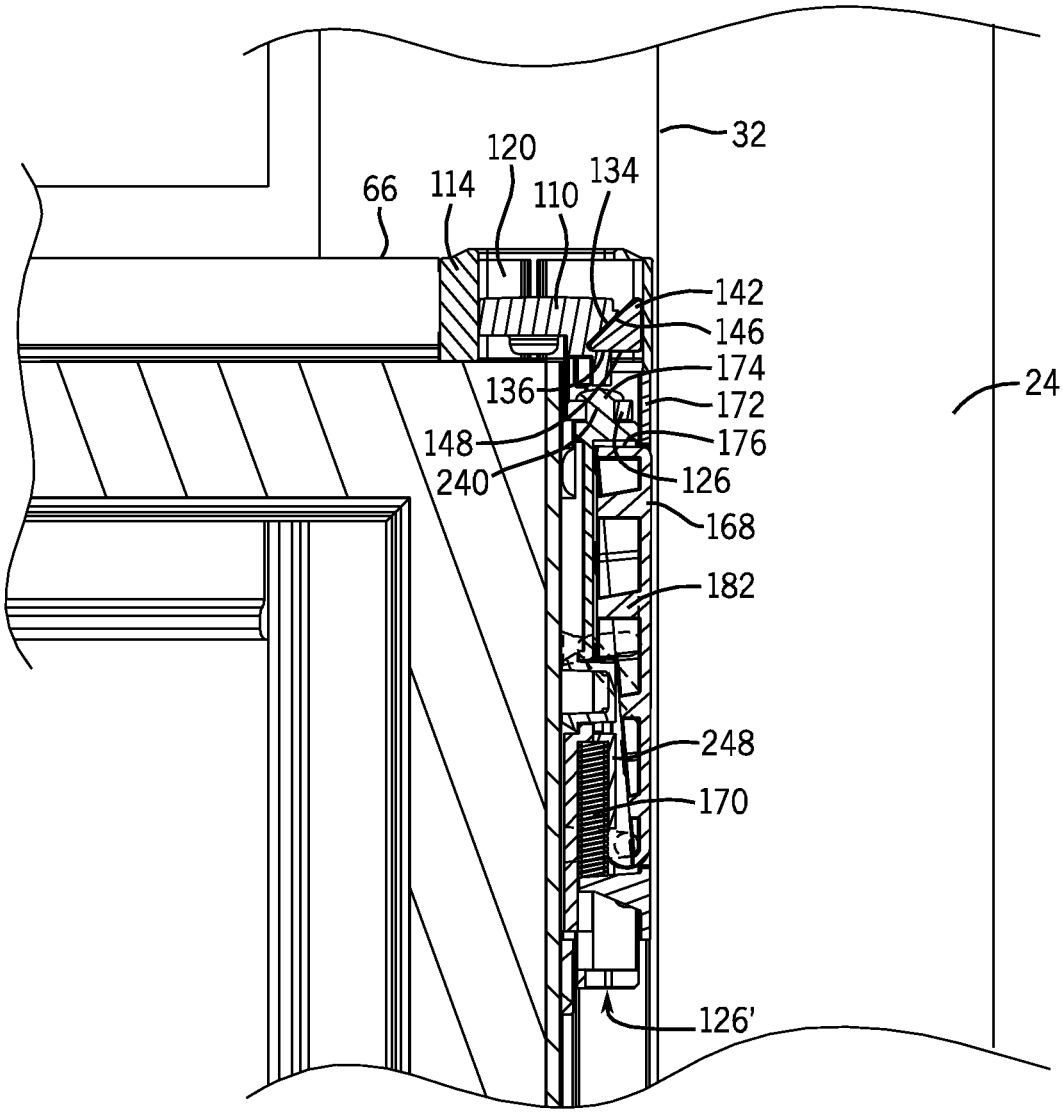
FIG. 10 is a cross-sectional view of the window and the tilt latch system of FIG. 9 taken along line 10-10.

Referring to FIGS. 9-10, the first sash 14 is shown in the open position and the tilt latch system 100 is shown in the unlocked position. When the tilt latch system 100 is in the locked position, the button 110 is maintained in the lowered position, the bolt 168 is maintained in the retracted position, and the lock-out pin 140 is in the extended position. It should be noted that the first side 182 of the bolt 168 is shown to be substantially flush with first wall 198 of the outer housing 172 in the refracted position. However, the bolt may be retracted to any position wherein it is removed from cavity 250 and does not interfere with the motion of the first sash according to other exemplary embodiments.

The tilt latch system 100 is configured to be automatically returned to the locked position by moving the first sash 14 from the open position to the closed position.

Referring further to FIGS. 9-10, to move the first sash 14 from the open position to a closed position, an operator typically pushes the first sash 14 generally upward and outward (e.g., rearward, along the z-axis as defined in FIG. 1) and slides the first sash 14 upward according to an exemplary embodiment. It should be noted that to move the second sash 16 from the open position to the closed position, an operator pushes the second sash 16 generally upward and outward and slides the second sash 16 downward.

As the upper rail 40 of the first sash 14 moves generally outward (e.g., rearward), the lock-out pin 140 that is extended rearwardly is brought into contact with the first upper jamb 28 and pressed inward (e.g., forward) toward the inner surface 48 of the sash frame 38 of the first sash 14. The inward motion of the lock-out pin 140 is indicated by motion arrow 262.

Referring further to FIGS. 9-10, pressing the lock-out pin 140 inward moves the lock-out pin 140 from the extended position to the retracted position, releasing the lock-out device 112 and the button 110 according to an exemplary embodiment. As the lock-out pin 140 moves forward, the lock-out stop 142 moves forward. When the lock-out pin 140 reaches the retracted position, the lock-out stop 142 is removed from the cavity 128 of the button 110. Without the second surface 148 of the lock-out stop 142 contacting the lower surface 136 of the cavity 128, the button 110 is released (e.g., no longer maintained in the lowered position). The button 110 and the inner housing 174 of the cartridge assembly 104 coupled thereto are able to move vertically upward. The biasing effect of the spring 170 is substantially no longer operatively countered by the button 110. Accordingly, the button 110 and the inner housing 174 are biased upward by the spring 170, moving both the button 110 and the inner housing 174 from their respective lowered positions to their raised positions. The upward movement of the button 110 indicated by motion arrow 264 in FIG. 9.

Pressing the lock-out pin 140 inward to move the lock-out pin 140 from the extended position to the retracted position also operatively releases the bolt 168. As mentioned above, with the lock-out stop 142 removed from the cavity 128, the inner housing 174 is biased vertically upward to its raised position (shown in FIG. 8). As the inner housing 174 moves upward, the motion of the second slots 234 therein causes the second pivots 180 to move away from the second wall 186 of the inner housing 174. The second pivots 180, which are also received in slots 214, are guided within slots 214 from positions in the second portions 218 of the slots 214 to positions in the first portions 216 of the slots 214, as indicated by motion arrow 266 in FIG. 9. Also, the first pivots 178 rotate toward the first vertical jamb 24; this movement is also indicated by an arrow in FIG. 9. Accordingly, as the second pivots 180 move from the second portions 218 to the first portions 216, moving the first pivots 178 toward the first vertical jamb 24, the bolt 168 is rotated toward the first vertical jamb 24 and into cavity 250. The biasing effect of the spring 170 maintains the bolt 168 in the engaged position, biases the button 110 in the raised position, and maintains the lock-out pin 140 in the retracted position (as shown in FIGS. 7-8).

Figure 11:
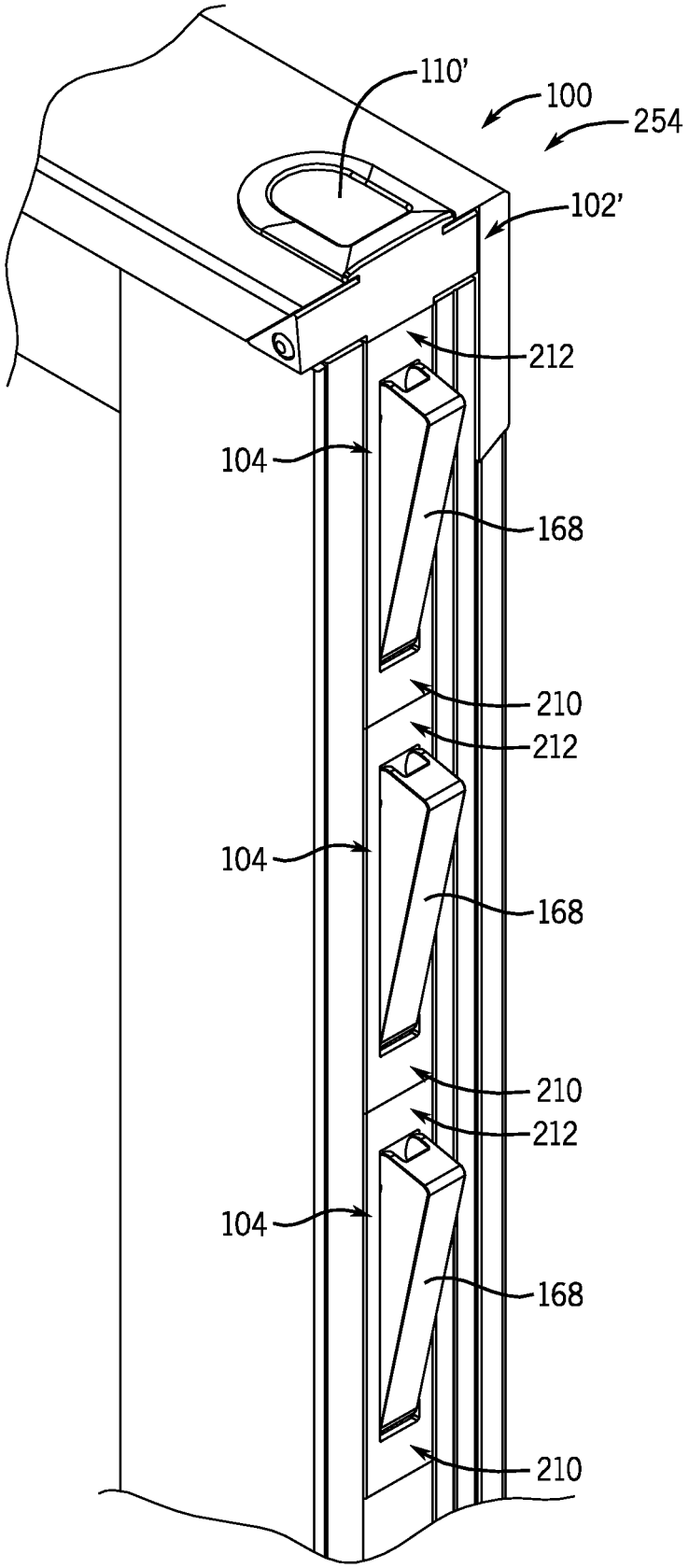
FIG. 11 is a partial rear perspective view of the double hung window and a tilt latch system according to an exemplary embodiment shown in FIG. 1 utilizing a plurality of cartridge assemblies.

FIG. 11 shows a rear perspective view of a first top corner 254 of the second sash 16 and the tilt latch system 100 utilizing modularity according to an exemplary embodiment. Specifically, a single button assembly 102 may be used in combination with more than one cartridge assembly 104. Utilizing multiple cartridge assemblies provides for multiple points of contact between a tilt latch system 100 and a window frame 14. Benefits of this configuration include, but are not limited to, improved security of the window 10 when closed and locked.

Referring further to FIG. 11, each cartridge assembly 104 in addition to the first cartridge assembly 104 coupled to the button assembly 102' can be easily added or removed by coupling or uncoupling, respectively, one cartridge assembly 104 to another cartridge assembly 104 according to an exemplary embodiment. As described above, each cartridge includes a second coupling feature 230 disposed on or generally above the top wall 224 of the inner housing 174 and a first coupling feature 126' disposed on or proximate to the bottom wall 226 of the inner housing 174. Each second coupling feature 230 is configured to be coupled to each a first coupling feature (e.g., 126 or 126') (and vice versa). Accordingly, the upper portions 212, 238 of the outer housing 172 and the inner housing 174 of one cartridge assembly 104 are adjacent and/or proximate to the lower portions 210, 236 of the outer housing 172 and the inner housing 174 of another cartridge assembly disposed generally there above. Also, as discussed above, the second coupling feature 230 enables any of the cartridge assemblies 104 to be coupled to the button 110 at the first coupling feature 126.

All of the cartridge assemblies 104 utilized in a modular configuration are operable using a single button assembly 102'. Pressing the button 110' of the button assembly 102' substantially simultaneously moves all of the bolts 168 of the cartridge assemblies 104 from their extended positions to their retracted positions. Similarly, moving the lock-out pin 140 of the button assembly 102' from the extended position to the retracted position automatically moves all of the bolts 168 from their retracted positions to their extended positions, locking the second sash 16 relative to the window frame 12. Generally, the discussion of the interaction of the button assembly 102' and the cartridge assembly 104 in FIGS. 1-10 applies to the button assembly 102' and the cartridge assemblies 104 shown in FIG. 11. It should be noted that different numbers of cartridge assemblies can be used with each tilt latch assembly. For example, the second sash 16 is shown including a single cartridge assembly in the tilt latch system at the second side and three cartridge assemblies in the tilt latch system at the first side. It should also be noted that more than one engagement member may be included in a cartridge assembly.

It should be noted that some the size and/or shape of some elements of a cartridge assembly may be varied without changing the general operation of the cartridges. Accordingly, each cartridge need not be completely identical to the other cartridges in the modular configuration (e.g., one bolt may have an opening at its side, the angle of the second slots in the inner housing may be different, etc.).

The button 110' shown in FIG. 11 illustrates an alternative, decorative design for a button included in a button assembly. It may be desirable to use decorative buttons on a lower sash (as shown in FIG. 1) because the buttons on a lower sash are more readily visible than the buttons on an upper sash, etc. It should be noted there is more latitude for the buttons on a lower sash to extend upward the upper surface of an upper rail than the buttons on an upper sash because the buttons on the lower sash do not risk interfering with the upper jamb of the window.

According to an exemplary embodiment, the orientation of various elements may differ and these variations are intended to be encompassed by the present disclosure.

According to an exemplary embodiment, the tilt latch system may be used with a door. According to other exemplary embodiments, the tilt latch system may be used with or adapted for use with other pivotable devices configured to open and close.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is important to note that the constructions and arrangements of the tilt latch system or components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A window in combination with a tilt latch assembly, comprising:

a window frame including an interior side generally opposite an exterior side, a first vertical jamb generally opposite a second vertical jamb, and an upper transverse jamb generally above a lower transverse jamb;

a sash including a glazing and a sash frame, the sash frame having an interior surface and an exterior surface, an upper rail generally opposite a lower rail, and a first stile generally opposite a second stile;

wherein the sash is inwardly pivotable about a horizontal axis generally aligned with the lower rail between a closed position, wherein the sash is generally parallel to the window frame, and an open position, wherein the sash is disposed at an angle relative to the window frame; and wherein the upper rail includes an inner surface generally opposite an outer surface, the outer surface facing the interior surface of the window frame when the sash is in the closed position and being spaced a distance from the interior surface of the window frame when the sash is in the open position; and a tilt latch system disposed at least partially within the sash frame and adapted to be placed in a locked state and an unlocked state, the tilt latch system comprising:

an actuator disposed proximate to an upper surface of the upper rail and movable in a direction generally parallel to the first stile between a raised position and a lowered position, the actuator being closer to the lower rail of the sash in the lowered position than in the raised position;

an engagement mechanism operatively coupled to the actuator, the engagement mechanism configured to move between an extended position, wherein the engagement mechanism is disposed at least partially within the first vertical jamb placing the tilt latch system in the locked state, and a retracted position, wherein the engagement mechanism is removed from the first vertical jamb placing the tilt latch system in the unlocked state;

wherein moving the actuator from the raised position to the lowered position operatively moves the engagement mechanism from the extended position to the retracted position, the motion of the engagement mechanism including a component generally perpendicular to the motion of the actuator and generally parallel to the glazing;

wherein the tilt latch system further comprises a first cartridge assembly that includes the engagement mechanism and an inner housing, the inner housing being operatively coupled to the actuator and slidable relative to an outer housing in a direction generally parallel to the motion of the actuator;

wherein the first cartridge assembly is configured to be operatively coupled to a second cartridge assembly being substantially identical to the first cartridge assembly, and wherein a lower portion of each cartridge assembly includes a first coupling feature and an upper portion of each cartridge assembly includes a second coupling feature, wherein the first coupling feature being configured to be coupled to the second coupling feature to couple the second cartridge assembly to the first cartridge assembly.

2. The window in combination with a tilt latch assembly of claim 1, wherein the tilt latch system further comprises a lock-out device configured to maintain the engagement mechanism in the retracted position when the sash is in the open position.

3. The window in combination with a tilt latch assembly of claim 2, wherein the lock-out device maintains the actuator in the lowered position when the tilt latch system is in the unlocked position and the sash is in the open position.

4. The window in combination with a tilt latch assembly of claim 2, wherein the lock-out device includes a first biasing device biasing a pin toward an extended position, the pin being movable between the extended position and a retracted position and configured to operatively disengage the lock-out device from the actuator when the upper rail is moved from the open position to the closed position, and wherein the pin is disposed a greater distance rearward of the outer surface of the sash frame in the extended position than in the retracted position.

5. The window in combination with a tilt latch assembly of claim 4, wherein the pin contacts the interior surface of the window frame or an interior surface of a second sash frame and is moved from the extended position to the retracted position as the sash is moved from the open position to the closed position.

6. The window in combination with a tilt latch assembly of claim 5, wherein moving the pin from the extended position to the retracted position operatively releases the actuator from the lowered position and provides for the actuator to be biased to the raised position by a second biasing device.

7. The window in combination with a tilt latch assembly of claim 6, wherein in the raised position the actuator operatively maintains the pin in the retracted position, the sash is in the closed position, and the tilt latch system is in the locked state.

8. The window in combination with a tilt latch assembly of claim 1, further including a third cartridge assembly being substantially identical to the first cartridge, wherein the actuator may be operatively coupled to the first cartridge assembly, the second cartridge assembly, and the third cartridge assembly all of which are generally aligned with the first stile, and wherein moving the actuator from the raised position to the lowered position operatively moves each of the engagement mechanisms of the cartridge assemblies from the extended position to the retracted position.

9. The window in combination with a tilt latch assembly of claim 1, wherein both pressing the actuator to move the actuator from the raised position to the lower position and moving the sash from the closed position to the open position include application of a force in a generally downward direction toward the lower rail.

10. The window in combination with a tilt latch assembly of claim 1, wherein the actuator is disposed in a bezel having an aperture providing a finger hold facilitating application of a force to move the sash from the closed position to the open position when the actuator is in the lowered position.

11. The window in combination with a tilt latch assembly of claim 10, wherein the actuator is a button that moves along an axis that extends through the first stile.

12. The window in combination with a tilt latch assembly of claim 11, further including a second actuator having a second button that moves along an axis that extends through the second stile, the second actuator disposed in a second bezel having a second aperture providing a second finger hold.

13. A tilt latch system for use with a window having a tiltable sash and adapted to be placed in a locked state and an unlocked state, comprising:

a button assembly, comprising:

a bezel including an aperture generally defining a first axis;

a button disposed at least partially within the aperture of the bezel, the button being movable in a direction generally parallel to the first axis between a raised position and a lowered position; and a pin movable between an extended position and a retracted position in a direction generally perpendicular to the first axis;

a first biasing device biasing the pin toward the extended position;

at least one cartridge assembly configured to be coupled to the button assembly, the button assembly disposed generally above the at least one cartridge assembly, the at least one cartridge assembly comprising:

an inner housing operatively coupled to the button and slidable relative to an outer housing in a direction generally parallel to the first axis;

a second biasing device disposed within a cavity formed by the inner housing and the outer housing; and an engagement mechanism disposed at least partially within the cavity and being biased out of the cavity by the second biasing device, the engagement mechanism being operatively coupled to the inner housing such that the engagement mechanism is movable in a direction generally perpendicular to the first axis between an extended position in which the button is in the raised position placing the tilt latch system in the locked state, and a retracted position, in which the button is in the lowered position, placing the tilt latch system in the unlocked state, the button being further from the engagement mechanism in the raised position than when the button is in the lowered position;

wherein in the locked state, the button is in the raised position, the pin is maintained in the retracted position, and the engagement mechanism is maintained in the extended position by the second biasing device;

wherein in the unlocked state, the button is maintained in the lowered position, the pin is moveable to the extended position, and the engagement mechanism is maintained in the retracted position;

wherein in the locked state, moving the button from the raised position to the lowered position operatively releases the pin and operatively moves the engagement mechanism to the retracted position;

wherein moving the pin from the extended position to the retracted position operatively releases the engagement mechanism from the retracted position and releases the button from the lowered position, automatically placing the tilt latch system in the unlocked state to the locked state; and wherein the engagement mechanism is a bolt that is pivotally coupled to the outer housing by a first set of pivots and slidably coupled to the outer housing by a second set of pins, and wherein the outer housing includes a set of holes configured to pivotally receive the first set of pivots and a set of slots configured to slidably receive the second set of pins.

14. The tilt latch system of claim 13, wherein moving the button from the raised position to the lowered position operably moves the inner housing from a raised position to a lowered position and operably counters the second biasing device.

15. The tilt latch system of claim 13, wherein the set of slots extend generally perpendicular to the first axis and generally perpendicular to the motion of the pin.

16. The tilt latch system of claim 15, wherein the inner housing includes a set of slots extending generally diagonally, the second set of pins being slidably received with the set of slots of the inner housing in addition to being received in the set of slots of the outer housing such that the engagement mechanism is moved between the extended position and the retracted position through the sliding of the inner housing relative to the outer housing when the button is moved between the raised position and the lowered position.

* * * * *